United States Patent [19]

Coutts

[11] 4,243,122

[45] Jan. 6, 1981

[54] LADDERS LEVELING DEVICE

[76] Inventor: Ian B. Coutts, 20 Kildare St., Burwood, Victoria, Australia, 3125

[21] Appl. No.: 970,967

[22] Filed: Dec. 19, 1978

Related U.S. Application Data

[63] Continuation-in-part of Ser. No. 819,174, Jul. 26, 1977.

[30] Foreign Application Priority Data

Jan. 6, 1977 [AU] Australia ..... PD0304

[51] Int. Cl.[3] ..... E06C 7/44

[52] U.S. Cl. ..... 182/200; 182/111

[58] Field of Search ..... 182/200, 107–111; 248/188.3, 188.2

[56] References Cited

U.S. PATENT DOCUMENTS 2,960,182 11/1960 Swanson ..... 182/200

FOREIGN PATENT DOCUMENTS 469181 4/1969 Switzerland ..... 182/200

903636 8/1962 United Kingdom ..... 182/200

*Primary Examiner*—Reinaldo P. Machado

*Attorney, Agent, or Firm*—Lockwood, Dewey, Alex & Cummings

[57] ABSTRACT

The present invention provides a base device for attachment to a ladder comprising a base, a top pivotally mounted on the base, ladder receiving means on the top of securably and releasably receiving the ladder therein, and adjustment means on the top for holding the top in a selected position relative to the base.

15 Claims, 4 Drawing Figures

LADDERS LEVELING DEVICE

This is a continuation-in-part of application Ser. No. 819,174, filed July 26, 1977.

BACKGROUND OF THE INVENTION

This invention relates to improvements in ladders and refers particularly, though not exclusively, to devices for attachment to ladders for improving the safety of the ladders when used.

Ladders have been used by mankind for countless centuries. Throughout their history the basic design and concept have remained unchanged. There have been some improvements such as the extension ladder and step ladders but the standard, everyday ladder has remained virtually unchanged. From basic geometry it can be ascertained that if a 30 foot long ladder is 5° off-angle then the top of the ladder is quite a distance from its correct position.

One of the major problems with ladders is their inherent instability when used on anything other than a horizontal plannar surface. In fact, when used on irregular and/or sloping surfaces the need for blocks and the like makes the use of a ladder extremely dangerous and, also, very time consuming. Also, when resting against smooth surfaces their tendency to slide can be rather dangerous. These have caused serious problems regarding the safety of persons using ladders. The large number of accidents both domestic and industrial each year is evidence of this. However, other than attempting to train the user of ladders, nothing has been done to overcome the problems. When one considers the cause of the accidents—the ladder itself—there has been nothing done in this regard. The basic design of ladders has never changed.

Many attempts have been made over the years to solve the well known problems which plague ladders and their use. Two such examples are those shown in the specifications of U.S. Pat. Nos. 983,172 of Sheetz and No. 973,509 of Ison, dated Jan. 31, 1911 and Oct. 25, 1910, respectively. These show complex and large structures designed to be attached to the lower rungs of the ladder. These devices both work off very similar principles but their constructions vary slightly. However, in each case these are good reasons why the devices shown are impractical—they are unsafe and do not comply with the basic requirements of such devices.

It is well known that a standard ladder has two rails and a number of rungs. It is required that the bottom rung be no more than 12 inches above the ground. As can be seen, neither of the Ison or Sheetz devices comply with this requirement. Furthermore, the rails of a ladder are far more capable of bearing loads than the rungs. With both the Sheetz and Ison devices, the rungs must bear not only the weight of a person using the ladder but also the weight of the ladder itself. This is, naturally, very unsafe. Furthermore, the devices of Sheetz and Ison are only suitable for use on soft ground due to the nature of the ground contact feet—they could not be used on paved surfaces or indoors.

Further devices are shown in the specifications of U.S. Pat. Nos. 2,205,935 of Stenroos and No. 2,960,182 of Swanson. The Swanson device has an arcuate tubular member which supports the rails and one rung of the ladder. A slip-lock device is used to hold the ladder in position relative to the tubular member. This device does not satisfy the basic safety requirements for devices for angular adjustment of ladders. The stenroos device is attached to the ladder in a manner very similar to that of Swanson but uses a series of alignable holes in three plates for providing the angular adjustment. Apart from the problems associated with all of the above described prior devices, the Stenroos device also has the problem that it requires a considerable effort for a user to adjust the device after moving from one locale to another.

Further, the calibration of most of these devices has been such that the control of the ladder is to within only approximately 5°—this being totally unsatisfactory.

SUMMARY OF THE INVENTION

It is therefore the principal object of the present invention to provide certain improvements in ladders in an attempt to overcome the abovementioned problems of the prior devices.

With the above and other objects in mind, the present invention provides a base device for attachment to a ladder comprising a base; ground engaging means depending from said base and being adapted to engage various types of surfaces; a top pivotally mounted to said base; ladder receiving means on said top for releasably and securably receiving a pair of spaced apart rails of said ladder therein; and adjustment means for holding said top in a selected position relative to said base.

BRIEF DESCRIPTION OF THE DRAWINGS

In order that the invention may be better understood and readily put into practical effect, there shall now be described by way of non-limitative example a preferred construction of a base device for attachment to a ladder incorporating the features of the present invention, the description being with reference to the accompanying illustrative drawings.

In the drawings.

DETAILED DESCRIPTION OF THE PREFERRED EMBODIMENT

Figure 1:
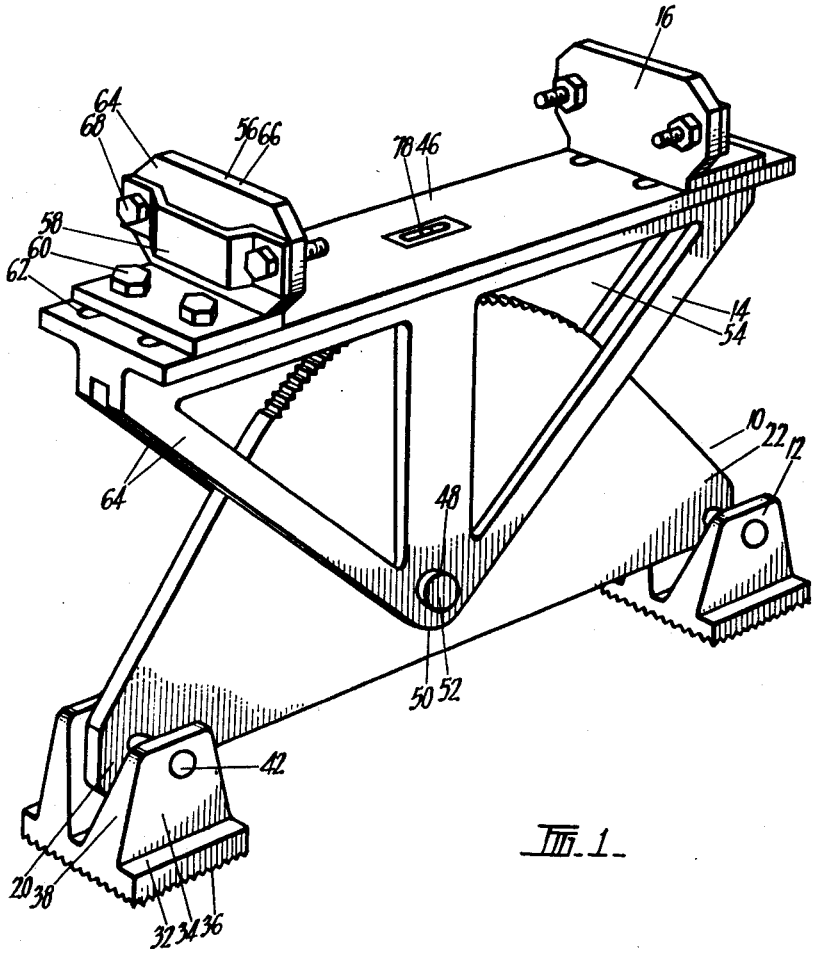
FIG. 1 is a front perspective view of the device.

As is described above, the device comprises a base 10 having two identical ground engaging means 12 depending therefrom at either end thereof, a top 14 pivotally attached to the base 10, two identical ladder receiving means 16 on the top 14 at either end thereof, and adjustment means 18 in the top to allow the top 14 to be placed in a selected position, relative to the base 10.

The base 10 is a piece of a flat metal plate and is approximately triangular in shape, with the two lower corners 20, 22 being somewhat rounded and the top 24 being arcuate. The arcuate top 24 has a number of teeth 26, as gear teeth, for the extent of the arcuate portion. At each corner 20, 22 the base 10 is provided with a hole 28 so as to enable the ground engagement means 12 to be attached to the base 10. Between the two holes 28 is a further hole 30 to enable the top 14 to be attached to the base 10.

Figure 2:
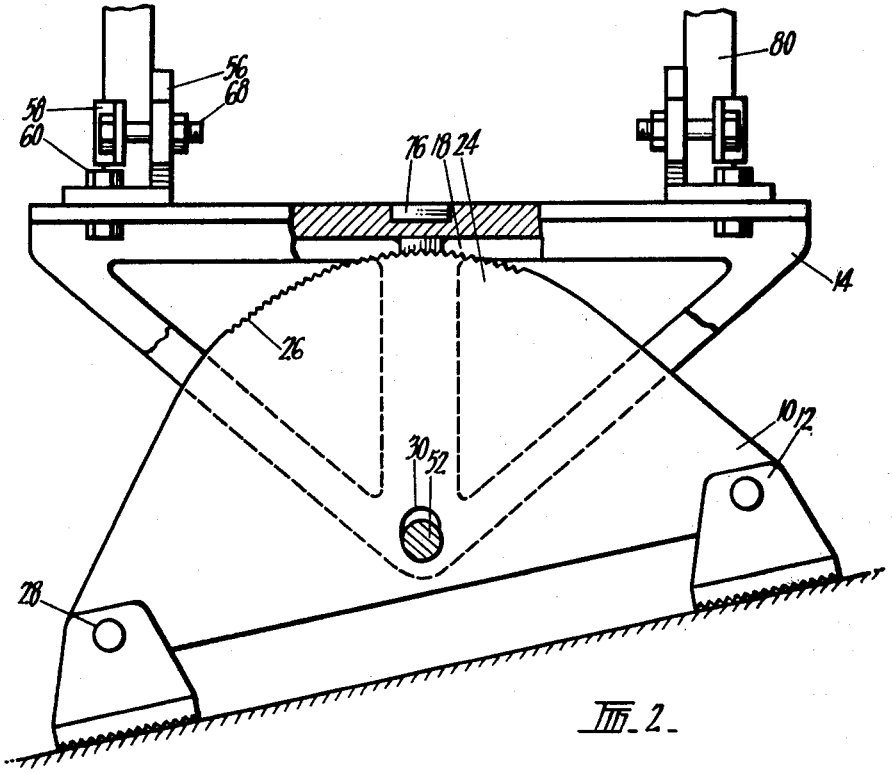
FIG. 2 is a front elevation in partial breakaway of the device of FIG. 1 in use situation.

Each ground engagement means 12 has a foot 32 and an attachment portion 34. The feet 32 are each approximately rectangular in shape and have an undersurface 36 which is roughened to enable the foot 32 to maintain a grip on almost any surface. The attachment portion 34 is approximately V in shape with the two arms 38 of the V being thicker adjacent the foot 32. Each arm 38 has a hole 40 at its upper end to enable the ground engagement means 12 to be secured to the base 10. Through each hole 40 and hole 28 in base 10 there is placed a pin 42 to hold the ground engagement means 12 in position relative to the base 10. The pin 42 is a force fit in holes 40 but is capable of movement in hole 28 so that the ground engagement means 12 can both pivot to allow for different surface geometry (see FIG. 2).

The top 14 is, like the base 10, approximately triangular in shape except that the point is lowermost. The construction of the top 14 is such that it has two identical triangular portions 44 enveloping the base 10, and a plate 46 at the upper end to the two portions 44. Each portion 44 has a hole 48 adjacent its lower point 50 so that a rivet 52 can pass therethrough and through hole 30 so as to hold the top 14 in position relative to the base 10.

Each triangular portion 44 has two identical triangular cut-outs 54 so as to reduce weight, but without significantly reducing the inherent strength of the top 14. The plate 46 is integral with the two triangular portions 44 and is of a width and surface finish suitable for it to be used as a step or rung. At each end of the plate 46 is a ladder receiving means 16 and in the centre of plate 46 is the adjusting means 18.

Each ladder receiving means 16 includes an approximately L-shaped member 56 which is releasably and movably attached to plate 46, and a rail retaining clamp 58 releasably attached to the member 56. Each L-shaped member 56 is attached to the plate 46 by means of two bolts 60 cooperating with suitable nuts (not shown) with the bolts passing through two parallel, longitudinal slots 62 in plate 46. The retaining clamp 58 is attached to the outer face 64 of the upright portion 66 of the L-shaped members 56 by two bolts 68 cooperating with suitable nuts (not shown).

Figure 4:
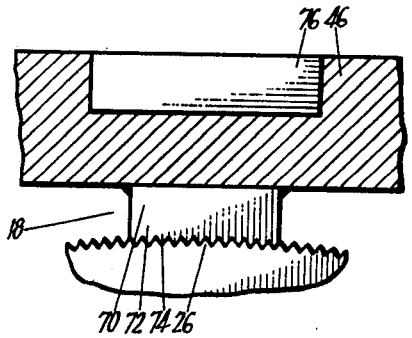
FIG. 4 is an enlarged side view of the adjustment means of the device of FIGS. 1 to 3.

The adjustment means 18 is best shown in FIG. 4 and comprises a block 70 secured to the under surface 72 of plate 46 by welding or any other suitable method. The block 70 has an under surface 72 which is concave in shape, the radius of curvature being the same as the radius of curvature of the arcuate top 24 of base 10. The surface 72 also has a number of teeth 74, as for gear teeth, which are designed to mate with the teeth 26 on arcuate top 24 of base 10. The hole 30 is oval in shape so that the top 14 can be lifted slightly to enable the teeth 74 to be removed from teeth 26 so that the angular position of the top 14 relative to the base 10 can be adjusted (see FIG. 2).

Furthermore, the plate 46 is provided with a recess 76 to accommodate a spirit level 78. In this way a user can easily determine when the ladder is in the correct position.

To use the device, the bolts 68 and 60 are loosened and the rails 80 of a ladder are placed between retaining clamp 58 and upright portion 66. The bolts 60 can move in slots 62 to allow for different spacings between the rails 80. Once both rails 80 are in position, bolts 60 and 68 are tightened to retain them in position relative to the plate 46. The ladder, with device attached, can then be moved to a work site. To adjust the device, the ladder rails are grasped and lifted. This causes the entire top 14 to lift slightly due to the rivet 52 moving in oval hole 30. The top 14 is then moved until the spirit level 78 indicates that the plate 46 is horizontal. The entire ladder and device is then lowered keeping plate 46 horizontal. The two feet 32 will engage the ground and adjust about pin 42 to ensure that surface 36 fully engages the ground. Rivet 52 will then move to the bottom of hole 30 and, at the same time, teeth 74 of block 70 will engage in teeth 26 on the arcuate top 24 of base 10. Thus, the base 10 firmly engages the ground with the plate 44 of top 14 remaining horizontal. The engagement of teeth 26 and 74 prevents movement of the top 14 relative to base 10 while the ladder is in use.

Figure 3:
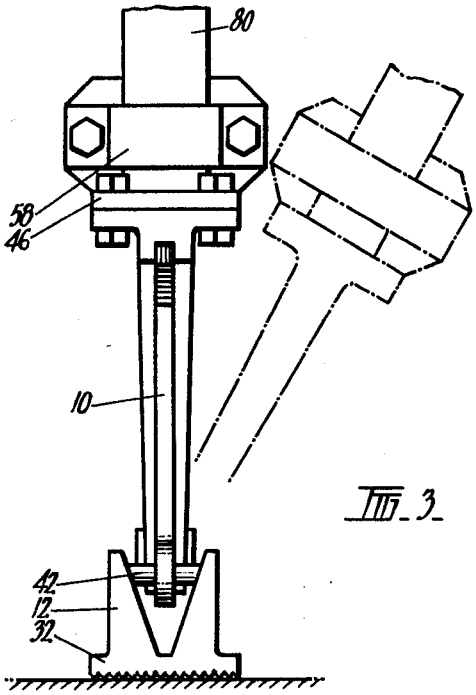
FIG. 3 is an end view of the device of FIG. 1.

Preferably, holes 28 are tapered at each end to allow the pins 42 to rock therein so that the ladder can be placed against a wall or the like without the feet 32 reducing their contact with the ground (see FIG. 3). Also, the plate 46 is constructed so as to act as an additional rung or step on the ladder so that a user does not have a great distance to the first rung.

As can be seen the present invention provides a base device to enable ladders to be used on sloping or rough ground—even on stairs and steps. Its operation is totally automatic in that the placing of the ladder in position causes the base device to make the necessary adjustment—particularly in view of the use of a spirit level. Furthermore, it is adjustable to suit a large range of ladder sizes and shapes and is designed for the top plate to be 12" or less from the ground so that it can be used as a step to comply with the relevant safety requirements.

Whilst there has been described in the foregoing description a preferred construction of a base device for ladders incorporating the features of the present invention, it will be understood by those skilled in the art that many modifications or variations in details of design or construction may be made without departing from the essence of the invention as is defined in the following claims.

What I claim is:

1. A base device for attachment to a ladder comprising a base; ground engaging means depending from said base and being adapted to engage various types of surfaces; a top pivotally mounted to said base, said top being approximately triangular in shape and comprising two identical portions enveloping said base, and a plate attached to the topmost edge of each of said two identical portions; ladder receiving means on said top for releasably and securably receiving a pair of spaced apart rails of said ladder therein; and adjustment means for holding said top in a selected position relative to said base.

2. A base device as claimed in claim 1, wherein said base has an arcuate upper portion having a number of gear teeth thereon, said teeth being adapted to engage with identical teeth on a block attached to said top so as to provide said adjustment means.

3. A base device as claimed in claim 2, wherein said base is approximately triangular in shape with said ground engaging means depending therefrom at either end thereof.

4. A base device as claimed in claim 3, wherein each ground engaging means comprises a foot having an undersurface adapted to grip a ground surface; and an approximately V-shaped attachment portion for attaching said foot to said base by means of a pin.

5. A base device as claimed in claim 1, wherein each of said two identical portions has a hole therethrough at the lowermost point thereof so as to enable a rivet to pass therethrough to attach said top to said base.

6. A base device as claimed in claim 5, wherein said rivet passes through an ovular hole in said base.

7. A base device as claimed in claim 1, wherein said ladder receiving means is attached to said plate, said plate being usable as a step.

8. A base device as claimed in claim 1, wherein each of said two identical portions has a plurality of cut-outs so as to reduce the weight to said base device.

9. A base device as claimed in claim 1, wherein said plate has depending therefrom a block having a curved undersurface with gear teeth thereon, said gear teeth being adapted to engage with identical gear teeth on a curved upper portion of said base so as to provide said adjustment means.

10. A base device for attachment to a ladder comprising a base; ground engaging means depending from said base and being adapted to engage various types of surfaces; a top pivotally mounted to said base; ladder receiving means on said top for releasably and securably receiving a pair of spaced apart rails of said ladder therein; and adjustment means for holding said top in a selected position relative to said base; said ladder receiving means comprising two L-shaped clamping devices securably and releasably attached to said top, the distance between said two L-shaped, clamping devices being adjustable to allow for various widths of ladders.

11. A base device as claimed in claim 10, wherein each of said two L-shaped clamping devices has a clamp thereon for securing a rail of a ladder therein.

12. A base device as claimed in claim 10, wherein said base has an arcuate upper portion having a number of gear teeth thereon, said teeth being adapted to engage with identical teeth on a block attached to said top so as to provide said adjustment means.

13. A base device as claimed in claim 12, where in said base is approximately triangular in shape with said ground engaging means depending therefrom at either end thereof.

14. A base device as claimed in claim 13, wherein each ground engaging means comprises a foot having an undersurface adapted to grip a ground surface; and an approximately V-shaped attachment portion for attaching said foot to said base by means of a pin.

15. A base device for attachment to a ladder comprising a flat plate base of triangular configuration, said base having an arcuate top with a plurality of gear teeth thereon; a ground engaging means pivotally attached to each end of said base, each ground engaging means having a foot with a roughened undersurface; a top pivotally attached to said base by means of a rivet passing through an ovular hole in said base, said top having two identical triangular portions enveloping said base, and a plate attached to the topmost edge of each of said two identical triangular portions; a ladder receiving means at each end of said plate and each having a clamp thereon for securably receiving a rail of said ladder, the distance between said two ladder receiving means being adjustable; and a block depending from said plate, said block having a number of gear teeth on an undersurface thereof for meshing with said plurality of gear teeth on said arcuate top of said base so as to provide for angular adjustment of said top relative to said base.

* * * * *